US007305337B2

(12) United States Patent
Wang et al.

(10) Patent No.: US 7,305,337 B2
(45) Date of Patent: Dec. 4, 2007

(54) METHOD AND APPARATUS FOR SPEECH CODING AND DECODING

(75) Inventors: Jhing-Fa Wang, Tainan (TW); Jia-Ching Wang, Tainan (TW); Yun-Fei Chao, Tainan (TW); Han-Chiang Chen, Tainan (TW); Ming-Chi Shih, Tainan (TW)

(73) Assignee: National Cheng Kung University, Tainan (TW)

( * ) Notice: Subject to any disclaimer, the term of this patent is extended or adjusted under 35 U.S.C. 154(b) by 848 days.

(21) Appl. No.: 10/328,486

(22) Filed: Dec. 24, 2002

(65) Prior Publication Data

US 2003/0139923 A1 Jul. 24, 2003

(30) Foreign Application Priority Data

Dec. 25, 2001 (TW) ..... 90132449 A

(51) Int. Cl.
*G10L 11/04* (2006.01)

(52) U.S. Cl. ..... 704/207; 704/219; 704/216; 704/211; 704/227

(58) Field of Classification Search ..... 704/207, 704/219, 230, 227, 223, 216, 211, 208
See application file for complete search history.

(56) References Cited

U.S. PATENT DOCUMENTS 5,426,718 A * 6/1995 Funaki et al. ..... 704/216
5,528,723 A * 6/1996 Gerson et al. ..... 704/211
5,673,361 A * 9/1997 Ireton ..... 704/219
5,774,837 A * 6/1998 Yeldener et al. ..... 704/208
5,826,226 A * 10/1998 Ozawa ..... 704/223
5,832,180 A * 11/1998 Nomura ..... 704/223
5,864,796 A * 1/1999 Inoue et al. ..... 704/219
6,012,023 A * 1/2000 Iijima et al. ..... 704/207
6,047,253 A * 4/2000 Nishiguchi et al. ..... 704/207
6,260,010 B1 * 7/2001 Gao et al. ..... 704/230
6,311,154 B1 * 10/2001 Gersho et al. ..... 704/219
RE38,269 E * 10/2003 Liu ..... 704/227
6,963,833 B1 * 11/2005 Singhal et al. ..... 704/207

* cited by examiner

*Primary Examiner*—Vijay B. Chawan

(57) ABSTRACT

The present invention includes a method for speech encoding and decoding and a design of speech coder and decoder. The characteristic of speech encoding method relies on the type of data with high compression rate after the whole speech data is compressed. The present invention is able to lower the bit rate of the original speech from 64 Kbps to 1.6 Kbps and provide a bit rate lower than the traditional compression method. It can provide good speech quality, and attain the function of storing the maximum speech data with minimum memory. As to the speech decoding method, some random noises are appropriated added into the exciting source, so that more speech characteristics can be simulated to produce various speech sounds. In addition, the present invention also discloses a coder and a decoder designed by application specific integrated circuit, and the structural design is optimized according to the software. Its operating speed is much faster than the digital signal processor, and suits the system requiring fast computation speed such as multiple line encoding; its cost is also lower than the digital signal processor.

1 Claim, 7 Drawing Sheets

| | R0 | R1 | R2 | R3 | R4 | R5 | R6 | R7 | R8 | R9 | R10 |
|---|---|---|---|---|---|---|---|---|---|---|---|
| c1 | 0-239 | 0-238 | 0-237 | 0-236 | 0-235 | 0-234 | 0-233 | 0-232 | 0-231 | 0-230 | 0-229 |
| c2 | 0-239 | 1-239 | 2-239 | 3-239 | 4-239 | 5-239 | 6-239 | 7-239 | 8-239 | 9-239 | 10-239 |

Fig.5

```
E=R[0];
for(i=1; i<=LPC_ORDER; i++) {
        s = 0.0;
        for(j=1; j<i; j++) {
            s += a [j][i-1]*R[i-j];
                }
         k = (R[i] - s) / E;
          a [i][i] = k;
          E*=(1-k*k);
        for(j=1; j<=i-1; j++) {
          a [j][i] = a [j][i-1] - k *  a [i-j][i-1];
        }
}
```

i.e. i=5 →

```
sum = 0.0;
sum = sum + a14 * R4
sum = sum + a24 * R3
sum = sum + a34 * R2
sum = sum + a44 * R1
K = (R5 - sum) / E;
a55 = K;
E = E * (1-K*K)
a15 = a14 - K*a44
a25 = a24 - K*a34
a35 = a34 - K*a24
a45 = a44 - K*a14
```

Fig.6

| 15 | 14 | 13 | 12 | 11 | 10 | 9 | 8 | 7 | 6 | 5 | 4 | 3 | 2 | 1 | 0 | Value of Quotient | Quotient x 3.0 | x 5.0 |
|---|---|---|---|---|---|---|---|---|---|---|---|---|---|---|---|---|---|---|
| sign | Whole | Whole | Whole | Small | Small | Small | Small | Small | Small | Small | Small | Small | Small | Small | Small | | | |
| 0 | 1 | 0 | 0 | 0 | 0 | 0 | 0 | 0 | 0 | 0 | 0 | 0 | 0 | 0 | 0 | 4.0 | 12.0 | > |
| 0 | 0 | 1 | 0 | 0 | 0 | 0 | 0 | 0 | 0 | 0 | 0 | 0 | 0 | 0 | 0 | 2.0 | 6.0 | > |
| 0 | 0 | 0 | 1 | 0 | 0 | 0 | 0 | 0 | 0 | 0 | 0 | 0 | 0 | 0 | 0 | 1.0 | 3.0 | < |
| 0 | 0 | 0 | 1 | 1 | 0 | 0 | 0 | 0 | 0 | 0 | 0 | 0 | 0 | 0 | 0 | 1.5 | 4.5 | < |
| 0 | 0 | 0 | 1 | 1 | 1 | 0 | 0 | 0 | 0 | 0 | 0 | 0 | 0 | 0 | 0 | 1.75 | 5.25 | > |
| 0 | 0 | 0 | 1 | 1 | 0 | 1 | 0 | 0 | 0 | 0 | 0 | 0 | 0 | 0 | 0 | 1.625 | 4.875 | < |
| 0 | 0 | 0 | 1 | 1 | 0 | 1 | 1 | 0 | 0 | 0 | 0 | 0 | 0 | 0 | 0 | 1.6875 | 5.0625 | > |
| 0 | 0 | 0 | 1 | 1 | 0 | 1 | 0 | 1 | 0 | 0 | 0 | 0 | 0 | 0 | 0 | 1.65625 | 4.96875 | < |
| 0 | 0 | 0 | 1 | 1 | 0 | 1 | 0 | 1 | 1 | 0 | 0 | 0 | 0 | 0 | 0 | 1.671875 | 5.015625 | > |
| 0 | 0 | 0 | 1 | 1 | 0 | 1 | 0 | 1 | 0 | 1 | 0 | 0 | 0 | 0 | 0 | 1.664062 | 4.992186 | < |
| 0 | 0 | 0 | 1 | 1 | 0 | 1 | 0 | 1 | 0 | 1 | 1 | 0 | 0 | 0 | 0 | 1.667969 | 5.003906 | > |
| 0 | 0 | 0 | 1 | 1 | 0 | 1 | 0 | 1 | 0 | 1 | 0 | 1 | 0 | 0 | 0 | 1.666016 | 4.998048 | < |
| 0 | 0 | 0 | 1 | 1 | 0 | 1 | 0 | 1 | 0 | 1 | 0 | 1 | 1 | 0 | 0 | 1.666992 | 5.000976 | > |
| 0 | 0 | 0 | 1 | 1 | 0 | 1 | 0 | 1 | 0 | 1 | 0 | 1 | 0 | 1 | 0 | 1.666504 | 4.999512 | < |
| 0 | 0 | 0 | 1 | 1 | 0 | 1 | 0 | 1 | 0 | 1 | 0 | 1 | 0 | 1 | 1 | 1.666748 | 5.000244 | > |

Fig.7

METHOD AND APPARATUS FOR SPEECH CODING AND DECODING

BACKGROUND OF THE INVENTION

1. Field of the Invention

The present invention relates to a method of speech coding and decoding and a design of speech coder and decoder, more particularly to a method of speech coding and decoding and a design of speech coder and decoder that reduces the bit rate of the original speech from 64 Kbps to 1.6 Kbps.

2. Description of the Related Art

Basically, the main purpose of the digital speech coding is to digitize the speech, and appropriately compress and encode the digitized speech to lower the bit rate required for transmitting digital speech signals, reduce the bandwidth for signal transmission, and enhance the performance of the transmission circuit. Besides lowering the bit rate of the speech transmission, we also need to assure the compressed speech data received at the receiving end can be synthesized into the sound with reasonable speech quality. At present, various speech coding techniques invariably strive to lower the bit rate and improve the speech quality of the synthesized sound.

In the development of low bit rate encoder, the U.S. National Defense Department announced a new standard of 2.4 Kbps for the mixed excitation linear predictive (MELP) vocoder after the FS1016 CELP 4.8 Kbps and caused the trend of studying the decoder of 2.4 Kbps or lower. The inventor of the present invention studied the present 2.4 Kbps standard such as the LPC10 and the mixed excitation linear predictive vocoder, and then developed a 1.6 kbps speech compression method. The implementation of speech technology by hardware is the key to the commercialization of the speech product that makes the speech technology as part of our life. The present invention completes the design of the hardware structure of the 1.6 kbps vocoder by the ASIC architecture with an execution speed faster than the digital signal processor, and fits the system requiring fast computation speed such as the multiple-line coder, and its cost is also lower than the digital signal processor.

SUMMARY OF THE INVENTION

The primary objective of the present invention is to provide a speech encoding method to lower the bit rate of the original speech from 64 Kbps to 1.6 Kbps in order to decrease the bit rate for transmitting the digital speech signal, reduce the bandwidth for transmitting the signal, and increase the performance of the transmission circuit.

The secondary objective of the present invention is to provide a speech coding method to assure that the compressed speech data can have reasonable speech quality.

Another objective of the present invention is to complete the hardware structure of the speech coder and decoder by the application specific integrated circuit (ASIC) design with an execution speed faster than the digital signal processor that suits the system requiring fast computation speed such as the multiple line coding, and its cost is also lower than the digital signal processor.

To accomplish the foregoing objectives, the present invention discloses a speech coding method to sample the speech signal by 8 KHz and divide the speech signal into several frames as the unit of the coding parameter transmission, wherein a frame sends out a total of 48 bits, the size of each frame is 240 points, and the bit rate is 1.6 Kbps. The coding parameters include a Line Spectrum Pair (LSP), a gain parameter, sound/soundless determination parameter, pitch cycle parameter, an 1-bit synchronized bit; wherein the method of finding the LSP is to pre-process the speech of the frame by Hamming Window, and find its autocorrelation coefficient for the linear predictive analysis to find the linear predictive coefficients with the scale from one to ten, and then convert them into the linear spectrum pair (LSP) parameters; the gain parameter uses the linear predictive analysis to find the autocorrelation coefficient and the linear predictive coefficient; the sound/soundless determination coefficient uses the zero crossing rate, energy, and the first level of linear predictive as the overall determination; the method of finding the pitch cycle parameter comprises the following steps:

Step 1: Find the maximum absolute value of all sampling point of the frame, which is also the value of the maximum point of the amplitude of vibration; if this value is positive, then the maximum value is used to find the pitch, and such maximum point is set as the pitch, and the 19 points in front of or behind the maximum point is reset to zero; if this value is negative, then the minimum value is set as the pitch, and the value of minimum point and the 19 points in front of or behind the minimum point are reset to zero;

Step 2. Set 0.69 times of the value of the maximum point of the foregoing amplitude of vibration as the threshold;

Step 3. If the frame is a positive source, it is used to find the main located pitch in order to find the maximum value of the current frame. If such value is larger than the threshold, then such point is set as the pitch, and the value of the current maximum point and the 19 points in front of or behind the maximum point are reset to zero. If the frame is a negative source, it is used to find the main located pitch in order to find the minimum value of the current frame; if such value is smaller than the threshold, then such point is set as the pitch, and the value of the current minimum point and the 19 points in front of or behind the maximum point are reset to zero;

Step 4: Repeat Step 3 to find the pitch until all points of the pitch from the positive source are smaller than the threshold, or all points of the pitch from the negative source are larger than the threshold;

Step 5: Sort the position of the pitch in ascending order $P_1$, $P_2$, $P_3$, $P_4$, $P_5$, and $P_6$;

Step 6: Use the positions of all pitches to find the interval $D_i=P_{i+1}-P_i$, i=1, 2, . . . , N (N is the number of pitches), and take the average of the interval to obtain the pitch cycle.

In addition, each frame is divided into 4 sub-frames at the decoding end, and the ten-scale linear predictive coefficient of each synthesized sub-frame is the interpolation between the linear spectrum pair parameter after quantizing the current frame and the quantized value of the linear spectrum pair parameter of the previous frame. The solution can be obtained by reversing the process. Furthermore, if the excitation source has sound, then the mixed excitation is adopted and composed of the impulse train generated by the pitch cycle and the random noises; if the excitation source has no sound, then only the random noise is used for the representation; moreover, after the excitation source with sound or without sound is generated, the excitation source must pass through a smooth filter to improve the smoothness of the excitation source; finally, the ten-scale linear predictive coefficient is multiplied by the past 10 synthesized speech signals and added to the foregoing speech excitation source signal and gain to obtain the synthesized speech corresponsive to the current speech excitation source signal.

Furthermore, the present invention discloses a speech coder/decoder to work with the foregoing method, which is designed with the application specific integrated circuit (ASIC) architecture, wherein the coding end comprises: a Hamming window processing unit for pre-processing the speech of each frame by the Hamming Window; an autocorrelation operating unit for finding the autocorrelation coefficient of the previously processed speech; a linear predictive coefficient capturing unit for performing the linear predictive analysis on the foregoing autocorrelation coefficient to find the ten-scale linear predictive coefficient and quanitize the coding; a gain capturing unit, using the foregoing autocorrelation coefficient and the linear predictive coefficient to find the gain parameter; a pitch cycle capturing unit, using the foregoing frame to find the pitch cycle, and a sound/soundless determining unit, using the zero crossing rate, energy, and the scale-one coefficient pf the foregoing linear predictive coefficient to determine whether such speech signal is with sound or without sound.

The decoding end comprises an impulse train generator for receiving the foregoing pitch cycle to generate an impulse train; a first random noise generator for generating a random noise, and when the sound/soundless determining unit determines the signal as one with sound, then the random noise and the impulse train are sent to an adder to generate an excitation source; a second random noise generator for generating a random noise, and when the sound/soundless determining unit determines the signal as one without sound, then the random noise is used to represent the excitation source directly; a linear spectrum pair parameter interpolation (LSP Interpolation) unit for receiving the foregoing linear spectrum pair parameter, and interpolating the weighted index between the linear spectrum pair parameter after quantizing the current frame and the quantized value of the linear spectrum pair parameter of the previous frame; a linear spectrum pair parameter to the linear predictive coefficient filter (LSP to LPC) for using the linear spectrum parameter after the foregoing interpolation to find the ten-scale linear predictive coefficient for each synthesized frame; a synthetic filter for multiplying the foregoing ten-scale linear predictive coefficient with the 10 speech signals and adding it to the foregoing speech excitation source and the gain to obtain the synthesized speech corresponsive to the current speech excitation source.

To make it easier for our examiner to understand the objective of the invention, its structure, innovative features, and performance, we use preferred embodiments together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which:

FIG. 5 shows the range of internal variables in the autocorrelation computation of the present invention.

FIG. 6 shows an example of expanding the Durbin algorithm of the present invention.

FIG. 7 shows the whole process of the computation of the algorithm in FIG. 6 according to the present invention.

DETAILED DESCRIPTION OF THE PREFERRED EMBODIMENTS

Figure 1:
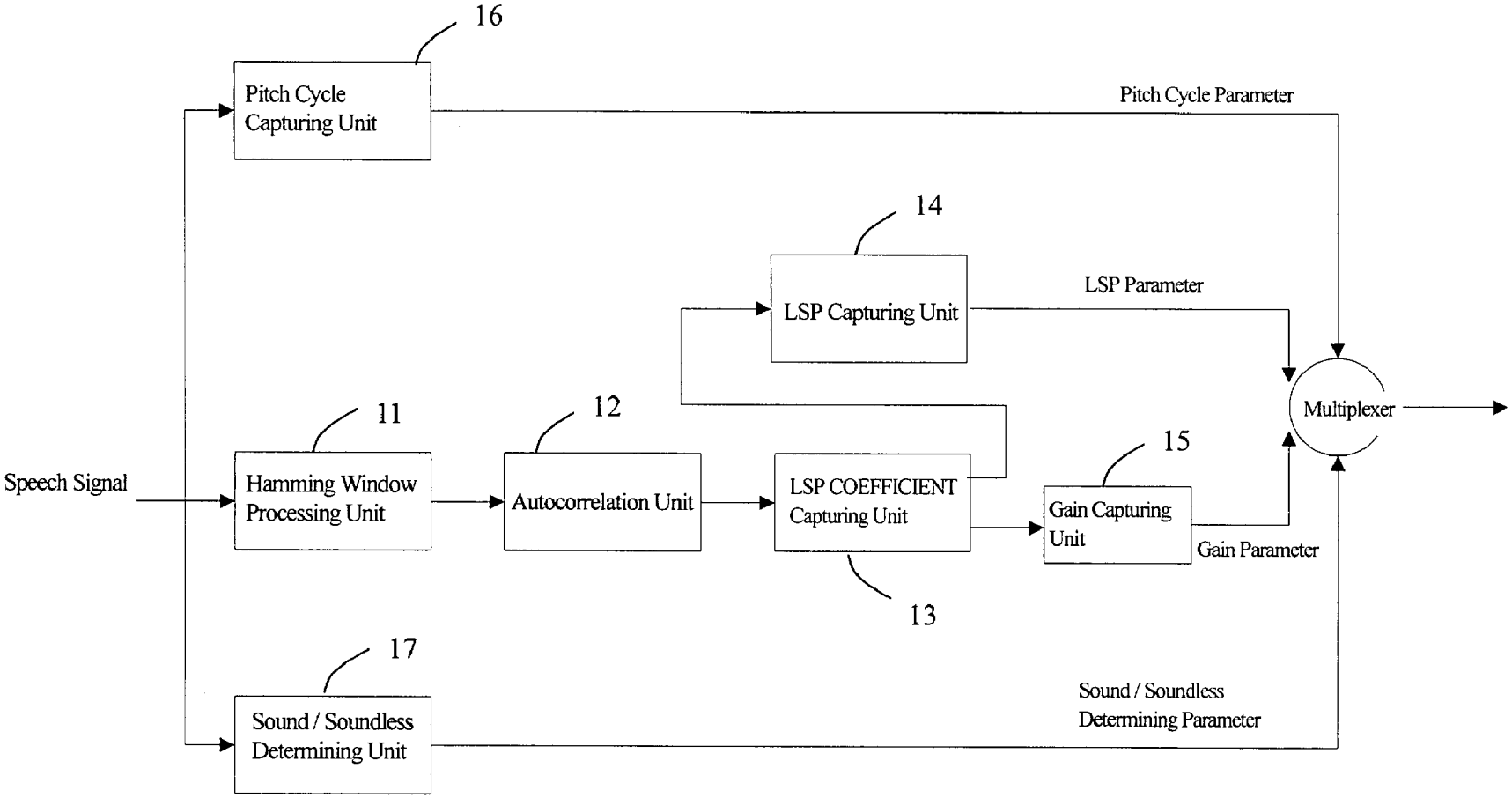
FIG. 1 is an illustrative diagram of the structure at the coding end of the present invention.

To fully disclose the present invention, the following preferred embodiments accompanied with the drawings are used for the detailed description of the present invention. The present invention is designed by application specific integrated circuit (ASIC) architecture, sampling the speech signal with 8 KHz, and dividing the sampled speech signal into several frames as the transmission unit of coding parameter, and the size of each frame is 30 ms (240 sample points); wherein the illustrative diagram of the coding end as shown in FIG. 1, comprises: a Hamming window processing unit 11, pre-processing the speech of each frame with the Hamming Window; an autocorrelation operating unit 12, finding the autocorrelation coefficient of said processed speech; a linear predictive coefficient capturing unit 13, performing a linear predictive analysis on said autocorrelation coefficient to find the ten-scale linear predictive coefficient; a linear spectrum pair coefficient capturing unit 14, converting said ten-scale linear predictive coefficient into a linear spectrum pair coefficient, and quantizing said coefficient for coding; a gain capturing unit 15, using said autocorrelation coefficient and linear predictive coefficient to find the gain parameter; a pitch cycle capturing unit 16, using said frame to find the pitch cycle parameter; a sound/soundless determining unit 17, using the zero crossing rate, energy, and the scale-one coefficient of said linear predictive coefficient to perform an overall determination on whether the speech signal is with sound or without sound.

The coding method of the present invention is to pre-process the speech of each frame by the Hamming Window, and use it to find the autocorrelation coefficient for the linear predictive analysis and the ten-scale linear predictive coefficient, and then convert said coefficient into Line Spectrum Pair (LSP), which is different from the LPC-10 Reflection Coefficients. Its physical significance is when the speech is fully opened or fully closed, the spectrograph forms a pair of linear lines close to the position where the resonant frequencies occur; the LSP occur in the interlacing manner, and its value falls between 0 and $\pi$, therefore the linear spectrum pair coefficient has good stability. In addition, the LSP has the features of quantization and interpolation to lower the bit rate, and thus we can convert the ten-scale linear predictive coefficient into the linear spectrum pair coefficient, and quantize the LSP parameter for coding.

Besides the linear spectrum pair parameter, this method also needs to transmit the speech parameters such as the gain, sound/soundless determination, and pitch cycle as described below:

(1) Gain

The gain can use the linear predictive analysis to find the autocorrelation coefficient and the linear predictive coefficient, and its formula is given below:

$$G = \sqrt{R(0) - \sum_{K=1}^{n} \alpha(k)R(k)}$$

Where, G is the gain, R(k) is the autocorrelation coefficient, α(k) is the linear predictive coefficient, and n is the number of linear predictive scale.

(2) Determination of Speech With Sound or Without Sound

Each frame needs to be determined as with sound or without sound, and such determination is to select different excitation source. If the frame is with sound, then select the excitation source with sound; if the frame is without sound, then select the excitation source without sound. Therefore the determination of speech with sound or without sound is very important, otherwise if such determination is wrong, then the excitation source will be determined wrong accordingly and the speech quality will also drop. There are many methods for determining the speech with sound or without sound, and the present invention uses three common methods, and they are described as follows:

a. Zero Crossing Rate: Zero crossing rate as implied in the name is the number of speech signal S(n) passing through the value of zero, which is also the number of having different positive and negative signs between two consecutive samples, and its formula is given below:

$$\text{sign}[S(n)] \neq \text{sign}[S(n+1)]$$

If the zero crossing rate is high, then it means that the speech in such section is without sound; if the zero crossing rate is low, then it means that the speech in such section is with sound, because the speech without sound is the energy of friction sound that gathers at the 3 KHz or above, and thus the zero crossing rate tends to be high.

b. Energy: The energy E(n) of the speech signal S(n) is defined as $$E(n) = \sum_{n=0}^{Size} S(n)^2$$

If the energy is large, then it means that the speech is with sound; if the energy is small, then it means that the speech is without sound, and the energy has been found when calculating the autocorrelation R(0).

c. Scale-one coefficient of the linear predictive coefficient: If such coefficient is large, then it means that the speech is with sound; if such coefficient is small, then it means that the speech is without sound.

If any two of the aforementioned 3 methods determines the sound is with sound, then the frame is a speech with sound, or else a speech without sound.

(3) Pitch

The algorithm for finding pitch cycle is described as follow:

Step 1: Find the absolute maximum for all of the sampled points of the frame, which is to find the value of the maximum point of the amplitude of vibration; if such value is positive, then the maximum value is the main located pitch. Set the value of such maximum point as the pitch, and reset the value of the maximum point and the 19 points in front of or behind the maximum point to zero; if such value is negative, the minimum value is the main located pitch. Set the value of such minimum point as the pitch, and reset the value of the minimum point and the 19 points in front of or behind the minimum point to zero, because some waveforms of the speech from the positive source can locate its pitch position easier, and some waveforms of the speech from the negative source can locate its pitch position easier, and the minimum of our pitch cycle is about 20, therefore we can set the 19 points close to the located pitch to zero.

Step 2: Set 0.68 of the amplitude of vibration at the maximum point as the threshold.

Step 3: If such frame is the main located pitch from a positive source, then we need to find the maximum of the current frames; if such value is larger than the threshold, then set such point as the pitch, and reset the value of the current maximum point and the 19 points in front of or behind the maximum point to zero. If such frame is the main located pitch from a negative source, then we need to find the minimum of the current frames; if such value is smaller than the threshold, then set such point as the pitch, and reset the value of the current minimum point and the 19 points in front of or behind the minimum point to zero.

Step 4: Repeat step 3 to find the pitch until all points of the main located pitch from the positive source are smaller than the threshold, or the main located pitch from the negative source are larger than the threshold.

Step 5: Since the sequence of the pitches position found is arranged in descending order, therefore we must sort the pitch positions in ascending order before we find the pitch cycle, and the sorted sequence will be $P_1$, $P_2$, $P_3$, $P_4$, $P_5$, and $P_6$.

Step 6. Finally, the interval of all pitch position found is $D_i = P_{i+1} - P_i$, i=1,2, . . . , N (N is the number of pitches), and take the average of the intervals as the pitch cycle P.

$$P = \frac{\sum_{i=1}^{N-1} D_i}{N-1}$$

Figure 2:
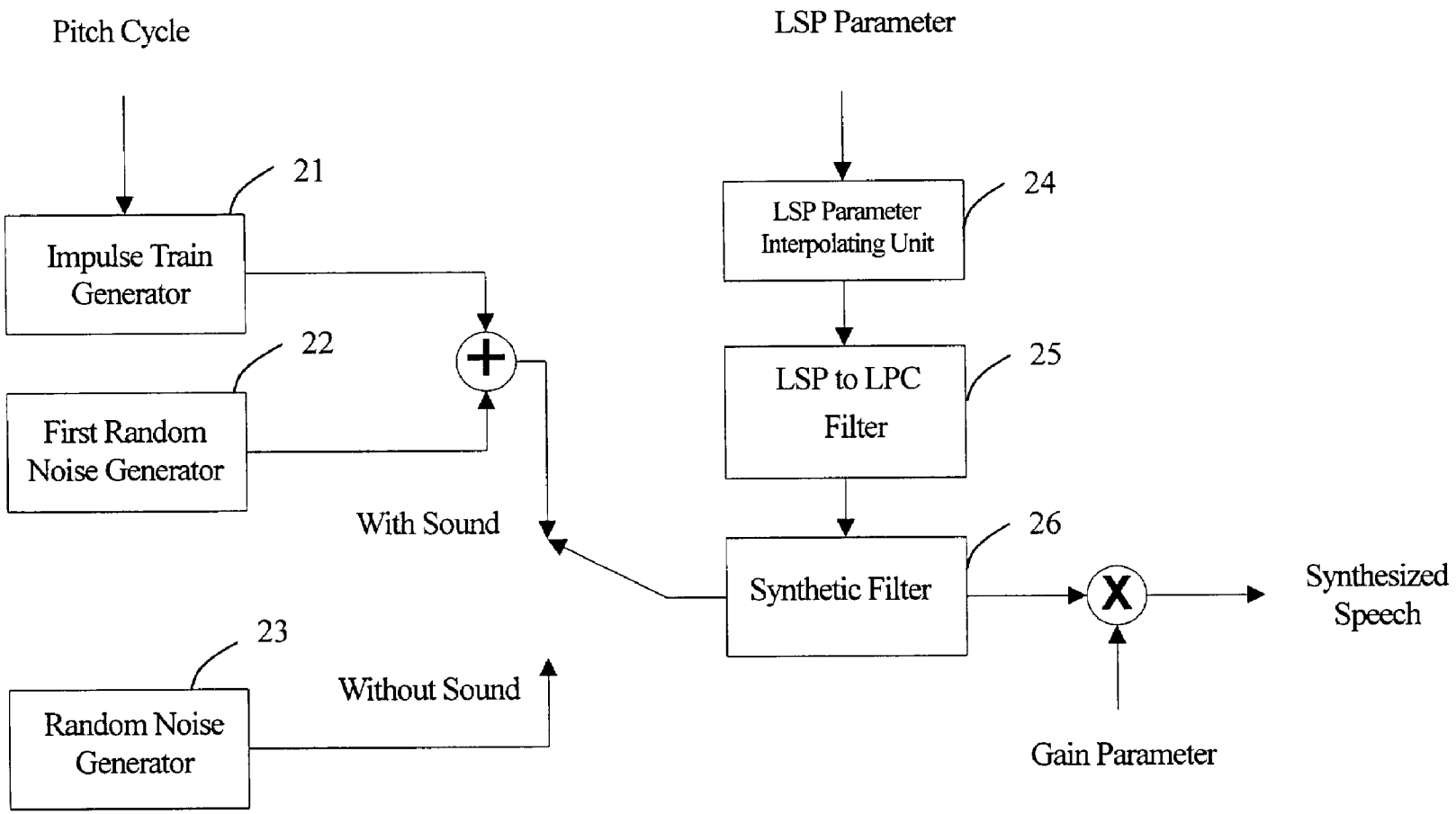
FIG. 2 is an illustrative diagram of the structure at the decoding end of the present invention.

The structural diagram at the decoding end is shown in FIG. 2. Each frame can be divided into 4 sub-frames, and the size of each frame is 7.5 ms (60 sample points), and the frame comprises: an impulse train generator 21, receiving the pitch cycle parameter to generate an impulse train, a first random noise generator 22 for generating a random noise; when said sound/soundless determining unit 17 determines the speech is with sound, then the random noise and said impulse train are sent to an adder to generate the excitation source; a second random noise generator 23 for generating a random noise; when said sound/soundless determining unit 17 determines the speech is without sound, then the random noise directly represents the excitation source; a linear spectrum pair parameter interpolation (LSP Interpolation) 24 receiving said linear spectrum pair parameter, and interpolating the weighted index between the linear spectrum pair parameter of the quantized frame and the linear spectrum pair parameter of the previous quantized frame; a linear spectrum pair parameter to a linear predictive coefficient parameter (LSP to LPC) filter 25 for finding the ten-scale linear predictive coefficient of each synthesized frame by said interpolated linear spectrum pair parameter; a synthetic filter, multiplying said ten-scale linear predictive coefficient with the past 10 speech signals and adding the speech excitation source and the gain parameter to obtain the synthesized speech corresponsive to the current speech excitation signal.

In the decoding method of the present invention, the linear predictive coefficient parameter of the synthesized sub-frame is interpolated between the linear spectrum pair parameter of the current quantized frame and the linear spectrum pair parameter of the previous quantized frame. The solution can be found by reversing the process. Refer to the following table for the weighted index of the interpolation.

| Sub-Frame No. | Previous Spectrum | Current Spectrum |
|---|---|---|
| 1 | 7/8 | 1/8 |
| 2 | 5/8 | 3/8 |
| 3 | 3/8 | 5/8 |
| 4 | 1/8 | 7/8 |

If the excitation source is with sound, then the mixed excitation is adopted and composed of the impulse train generated by the pitch cycle plus the random noise. The purpose of the mixed excitation is to appropriately add some random noises to the excitation source in order to simulate more possible speech characteristics to produce various speeches with sound, avoid the feeling of traditional linear predictive analysis mechanical sound and annoying noise, improve the natural feeling of the synthesized speech, and enhance the speech quality of the sound, which the traditional LPA lacks the most. If the speech is without sound, then only the random noise is used for the representation.

Furthermore, this method adds the following two strategies for enhancing the synthesized speech quality:

(1) Excitation Source Smooth Filter

Figure 3A:
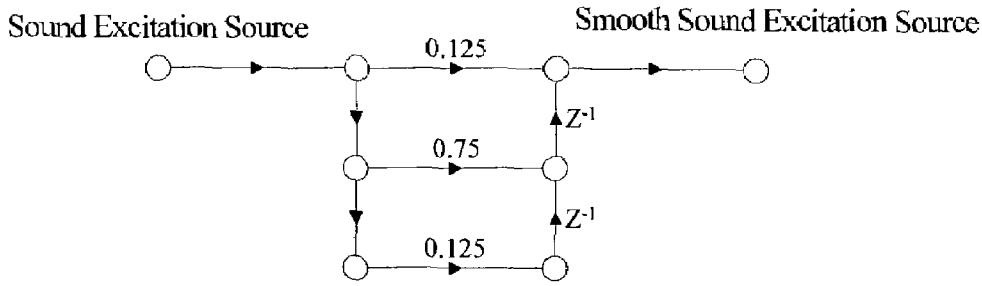
FIG. 3A is a diagram of the smooth filter when the excitation source is one with sound according to the present invention.
Figure 3B:
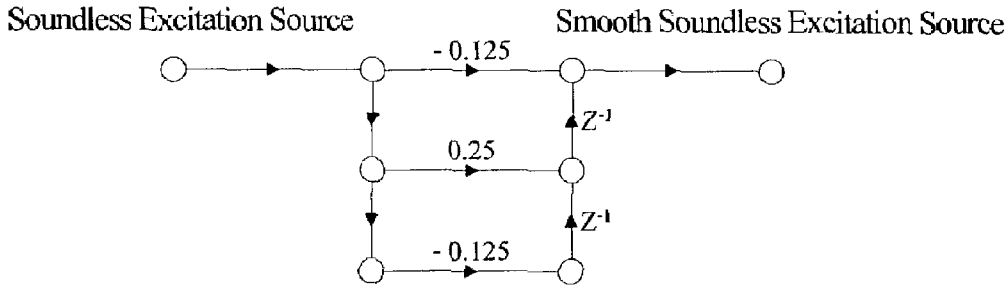
FIG. 3B is a diagram of the smooth filter when the excitation source is one without sound according to the present invention.

The excitation source smooth filter enables the decoding end to have a better speech excitation source.

a. For the speech with sound, its smooth filter is shown in FIG. 3A:

$$A(z)=0.125+0.75z^{-1}+0.125z^{-2}$$

b. For the speech without sound, its smooth filter is shown in FIG. 3B:

$$A(z)=-0.125+0.25z^{-1}+0.125z^{-2}$$

(2) Continuity of Pitch Cycle Between Frames

Figure 4:
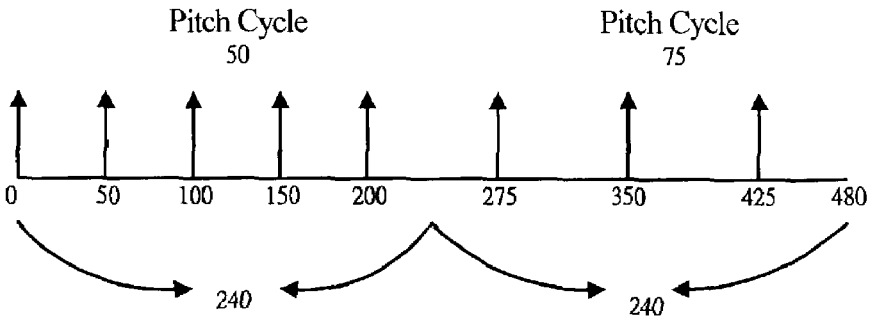
FIG. 4 is a diagram of the consecutive pitch cycle of the frame of the present invention.

The issue of continuity between frames must be taken into consideration, and the processing method is to record the size of the remaining points of the previous frame, and generate the impulse train of the excitation from the current frame by the remaining point plus the pitch cycle of the current frame. For example, if the pitch cycle of the current frame is 50, the remaining point will be 40. If the pitch cycle of the current frame is 75, then the starting point of the current frame to generate the impulse train is changed to 35 to enhance the continuity between the frames as shown in FIG. 4.

Since the coding method of the present invention does not employ the reflection coefficient but use the linear spectrum pair parameter instead, therefore it can save the number of bits. The bit allocation takes 34 bits to transmit the ten-scale linear spectrum parameter per frame, 1 bit for the determination of the speech with sound or without sound, 7 bits for the pitch cycle, 5 bits for the gain, 1 bit for the synchronized bit, and thus each frame transmits a total of 48 bits per frame. The size of each frame is 240 points, and the bit rate is 1.6 Kbps.

The following focuses on the autocorrelation operation, linear predictive coefficient capturing, linear spectrum pair parameter capturing, gain capturing, and pitch cycle capturing adopted by the coding method. Their operations are analyzed first, and then the design of their hardware structure is proposed according to the formula for the computation.

[Design of Hardware Structure of Autocorrelation Computation]

The number of computations for the autocorrelation computation is the largest among all methods of calculating the speech parameter. Taking the ten-scale autocorrelation computation for example, it requires 11 computations to calculate from R0 to R10. Taking R0 for example, it requires 240 multiplications and 239 additions; R1 requires 239 multiplication and 238 additions, and so forth, R11 requires 230 multiplications and 229 additions. If control ROM is used to control the multiplication and addition and save the results in the registers, the number of control words is 5159, which is too large and too inefficient.

Since the autocorrelation algorithm has a fixed cycle, therefore the present invention proposes a solution by finite status machine, the finite status machine is directly used to send control signal to the data path. An autocorrelation computation of a frame with 240 points is taken for example:

$$R(k)=\sum_{m=0}^{239-k} x(m)x(m+k) \tag{1.1}$$

Regardless of the scale, the condition for its termination is when x(m+k)=x(239) in the Equation (1.1). We use two sets of address counters c1 and c2 in the circuit to represent the values of x(m) and x(m+k) respectively, and the calculation of the range of c1 and c2 for each scale is distributed as shown in FIG. 5. In the calculation of the finite status machine of the autocorrelation, if c2=239, then shift the status to next scale for the computation.

Divide the autocorrelation into 6 states, which are described as follows:

S1: Load R1

S2: Load R2

S3: Load R4 (execute R1×R2)

S4: Load R3

S5: Execute R3+R4

S6: If (c2=239), End of calculation R(0 . . . 10) and store the value,

Else c2=c2+1,c1=c1+1

S0: Stop state

There are two sets of address counters c1 and c2 in the control unit to generate the x(m) and x(m+k) addresses. If the state of the finite status machine is 6, the control unit will determine if c2 is 239 to end the multiplication and addition of a certain scale for the autocorrelation. The autocorrelation computation is a data path composed of multiplication and addition, therefore after a multiplier completes a multiplication, the adder immediately accumulates the product, and the accumulation register will store the computed autocorrelation value and regulate the autocorrelation value below 16384 through the barrel shifter.

[Design of Hardware Structure of Linear Predictive Coefficient Capturing]

Immediately after the autocorrelation coefficient is found, we will use Durbin algorithm to find the linear predictive coefficient as follows:

$$K_i = \left( R(i) - \sum_{j=1}^{i-1} \alpha_j^{i-1} R(i-j) \right) \Big/ E^{i-1}$$

$$E^{(0)}=R(0)$$

$$\alpha_i^{(i)=K_i}$$

$$\alpha_j^{(i)=\alpha_j^{(i-1)}}-K_i\alpha_{i-j}^{(i-1)}1\leqq j\leqq i-1$$

$$E^{(i)}=(1-K_i^2)E^{(i-1)})$$

$$\alpha_j=\alpha_j^{(p)}\ 1\leqq j\leqq p$$

Where, $E^{(i)}$ is the estimated error.

R(i) is the autocorrelation coefficient.

$K_i$ is the partial derivative coefficient.

$\alpha_j^{(i)}$: is the $j^{th}$ predictive parameter in scale i.

$$R(k) = \sum_{m=0}^{N-1-k} S(m)h(m)S(m+k)h(m+k)$$

S(n) is the inputted speech signal.

h(n) is the Hamming window.

There are three loops in the Durbin algorithm of the present invention, which are derived into instruction by instruction, and the microinstruction set is used to control the data path for the computation of capturing the linear predictive coefficient. For example, i=5, the expanded algorithm is shown in FIG. 6. Since the algorithm has a division operation; taking the ten-scale Durbin algorithm for example, there are 10 division operations for the all (first one in scale one), a22, a33, a44, a55, a66, a77, a88, a99, a1010 (tenth one in scale ten). According to the analysis of the data range, the values of such quotients will not exceed the range of ±3.0. Therefore we design a divider specially for calculating the linear predictive coefficient. The concept of dichotomy is used to find the quotient. Besides the sign bit, there is a total of 16 bits that require changes, and the method is described as follows:

1. set initial value,
   quotient=16'b0100_0000_0000_0000
   clear=16'b1011_1111_1111_1111
   add=16'b0010_0000_0000_0000
2. temp=multiply quotient by divisor
3. compare temp with dividend.
   if (temp>dividend) quotient(new)=quotient(old) & clear|add;
   else quotient(new)=quotient(old)|add
4. add >>=1; clear>>=1; //add and clear variable are right shift 1 bit
5. if (add =0) exit
   else jump to 2

For example, the whole process of using 5.0 to divide 3.0 as the algorithm of the computation is shown in FIG. 7. The value of finally obtained quotient is 0001_1010_1010_1011 (1.666748).

[Design of Hardware Structure of Linear Spectrum Pair Parameter Capturing]

The method of converting the linear predictive coefficient into the linear spectrum pair parameter is described first. The physical significance of the linear spectrum pair parameter stands for the spectrum pair parameter polynomials P(z) and Q(z) provided the sound track is fully opened or fully closed. These two polynomials are linearly correlated, which can be well used for the linear interpolation during decoding in order to lower the bit rate of the coding. Thus, it is widely used in various speech coders.

$$P(z)=A_n(z)+z^{-(n+1)}A_n(z^{-1}) \tag{2.1}$$

$$Q(z)=A_n(z)-z^{-(n+1)}A_n(z^{-1}) \tag{2.2}$$

Equations (2.1) and (2.2) are further derived into:

$$P(x)=16x^5+8p_1x^4+(4p_2-20)x^3-(8p_1-2p_3)x^2+(p_4-3p_2+5)x+(p_1-p_3+p_5) \tag{2.3}$$

$$Q(x)=16x^5+8q_1x^4+(4q_2-20)x^3-(8q_1-2q_3)x^2+(q_4-3q_2+5)x+(q_1-q_3+q_5) \tag{2.4}$$

Where $$x=\cos\omega$$

$$p_1=a_1+a_{10}-1$$

$$p_2=a_2+a_9-p_1$$

$$p_3=a_3+a_8-p_2$$

$$p_4=a_4+a_7-p_3$$

$$p_5=a_5+a_6-p_4$$

$$q_1=a_1-a_{10}+1$$

$$q_2=a_2-a_9+q_1$$

$$q_3=a_3-a_8+q_2$$

$$q_4=a_4-a_7+q_3$$

$$q_5=a_5-a_6+q_4 \tag{2.5}$$

$a_{10}$, $a_9$, $a_8$, . . . ,$a_1$ are the ten-scale linear predictive parameters; the roots of P(x) and Q(x) are the linear spectrum pair parameters.

Equations (2.3) and (2.4) can be divided by 16 without affecting the roots.

$$P'(x)=x^5+g_1x^4+g_2x^3+g_3x^2+g_4x+g_5 \tag{2.6}$$

$$Q'(x)=x^5+h_1x^4+h_2x^3+h_3x^2+h_4x+h_5 \tag{2.7}$$

To improve the accuracy and reduce the number of computations, Equations (2.6) and (2.7) can be changed into the nested form:

$$P'(x)=((((x+g_1)x+g_2)x+g_3)x+g_4)x+g_5 \tag{2.8}$$

$$Q'(x)=((((x+h_1)x+h_2)x+h_3)x+h_4)x+h_5 \tag{2.9}$$

In Equation (2.6), it takes 15 multiplications and 5 additions, and Equation (2.8) only takes 4 multiplication and 5 additions, which reduces the number of multiplication and greatly improves its accuracy. The g1~g5 and h1~h5 in Equations (2.8) and (2.9) can be converted from the following equations.

$$g5=0.03125*P5-0.0625*P3+0.0625*P1$$

$$g4=0.0625*P4-0.1875*P2+0.3125$$

$g3=0.125*P3-0.5*P1$ $g2=0.25*P2-1.25$ $g1=0.5*P1$ $h5=0.03125*Q5-0.0625*Q3+0.0625*Q1$ $h4=0.0625*Q4-0.1875*Q2+0.3125$ $h3=0.125*Q3-0.5*Q1$ $h2=0.25*Q2-1.25$ $h1=0.5*Q1$

Figure 8:
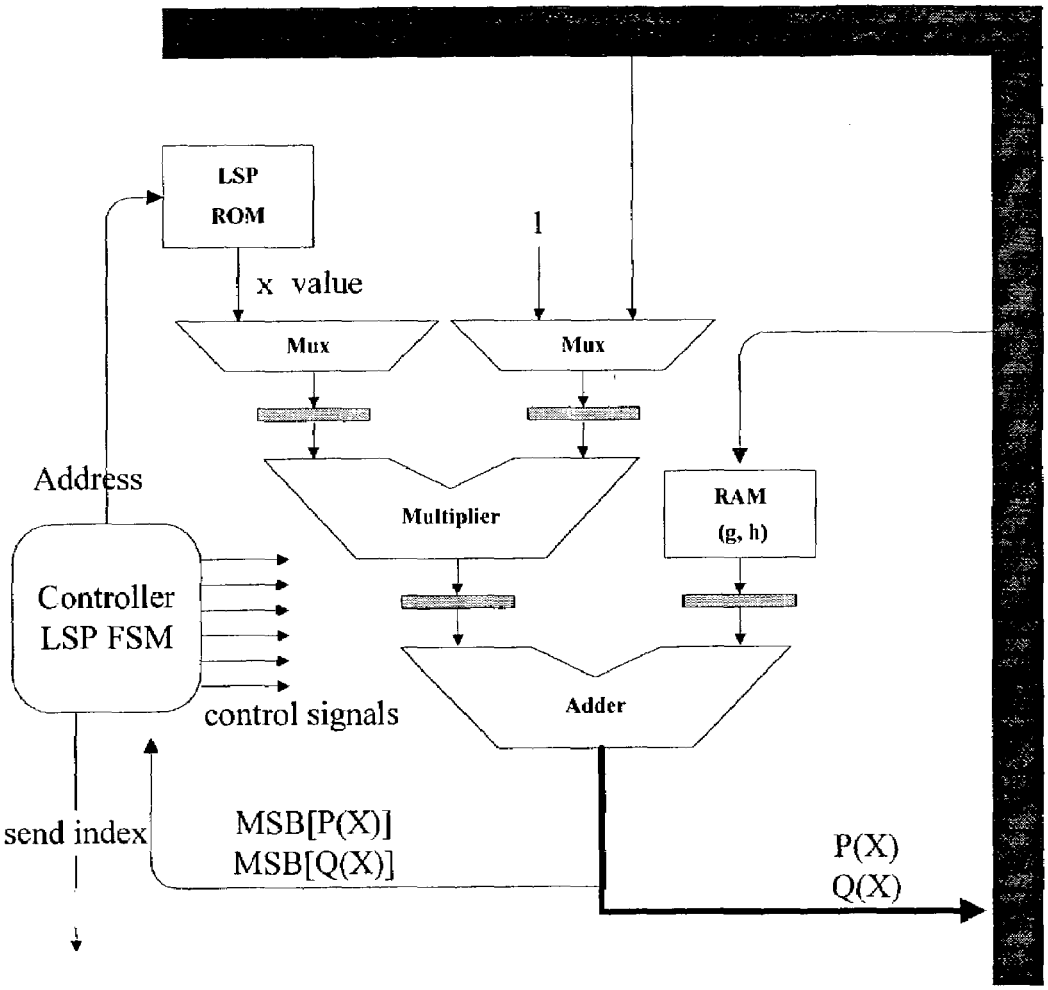
FIG. 8 is a diagram of the hardware structure of the linear spectrum parameter capturing unit.

FIG. 8 shows the diagram of the hardware structure of the linear spectrum pair parameter capturing unit. We use three levels of pipeline structure to implement the whole computation; the first level of the pipeline is used to read data into the register, the second level to execute the operation of multiplication, and the third level to execute the operation of addition.

The index value of the linear spectrum pair parameter of each level is stored in the Look Up Table (LUT). Before solving the equations, we must compute the coefficients g1~g5 and h1~h5 of the polynomials and save these values into the RAM first. Solving the LSP is actually finding the roots. We use the Newton's root to solve the roots, that is when P(a)P(b)<0, a root of P(x) exist between a and b. Therefore, in the structure, we need to compare the circuit to determine the positive and negative sign of the P(a)P(b), since P(a) and P(b) are two complementary numbers, therefore comparing the circuit with an exclusive OR gate can solve the problem.

The start and end of the whole computation is controlled by the linear spectrum pair parameter of the finite status machine (LSP_FSM). The purpose of the LSP_FSM relies on sending a signal to notice the LSP_FSM that the currently desired root is found when the comparison of the circuit has found that root, and execute the operation of saving the index, and then continue to find the LSP index for the next scale until all 10 scales of the linear spectrum pair are found. Therefore, the LSP_FSM is used to control the computation of a sequence of linear spectrum pair indexes. In addition, the controller will follow the instruction given by the LSP_FSM to control the look up table (LUT) and send the values to the register (REG) or the content of register file is stored into the register, and control the operation of other computation units.

[Design of Hardware Structure of Gain Capturing]

Figure 9:
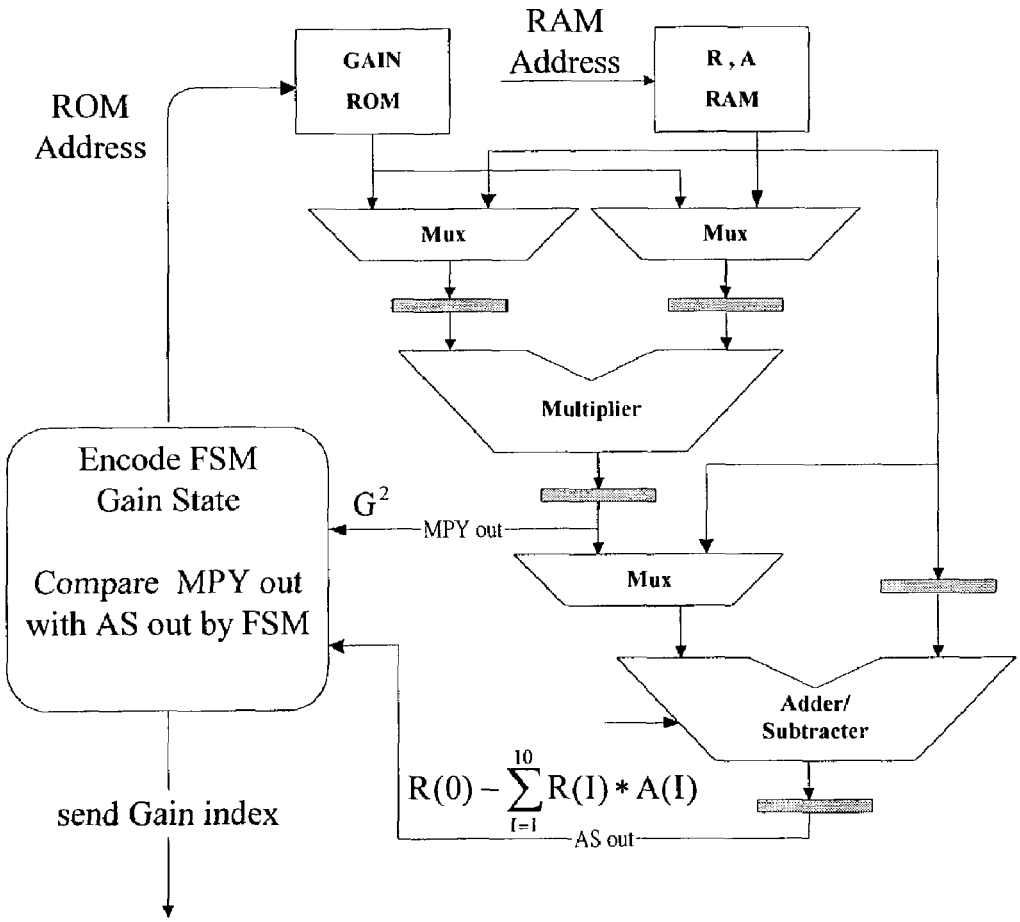
FIG. 9 is a diagram of the hardware architecture of the gain capturing unit.

Refer to Equation (3.1) for the operation of gain. Since there is a square root sign in Equation (3.1), therefore it is modified to Equation (3.2) to avoid additional circuit design of the square root sign, so that the computation only needs the mathematical operations of addition, subtraction, and multiplication. The structure of the circuit architecture is shown in FIG. 9. The value on the right side of the equal sign in Equation (3.2) is calculated from the data path and stored in the R5 register, and the value of G has 32 index values corresponding to 32 different kinds of gain values that are stored in the ROM. The gain value can be found from the sequence of the table, and then sent to the adder before sending the value of the square of G and being saved in the R3 register. The finite status machine of the gain of the control unit is used to compare with the values in the registers R3 and R5 until they match with the closest value, and then the index value is coded.

$$G = \sqrt{R(0) - \sum_{I=1}^{10} A(I) * R(I)} \tag{3.1}$$

$$G^2 = R(0) - \sum_{I=1}^{10} A(I) * R(I) \tag{3.2}$$

[Design of Hardware Structure of Pitch Cycle Capturing]

To simplify the hardware design, we simplify the pitch cycle capturing method as follows:

(1) Find the absolute maximum value in a frame as the peak. If the peak is positive, then the positive source is set as the main located pitch cycle; if the peak is negative, then the negative source is set as the main located pitch cycle.

(2) Set a threshold (TH) to 0.68 times the value of the peak.

(3) Only take the sampled point exceeding the threshold into account, and find a sample point larger than the threshold starting from the first point. Assumed that the position is at sp[n], skip 30 sample point sp[n+30] and set the counter to 30, and then find the second sample point starting from sp[n+30], and increment the counter by 1 when one sample is located; until the second sample point larger than or equal to the threshold, and the counter shows the pitch cycle.

The 48 bits generated after coding of the present invention are saved into the register composed by a group of 48 bits, and the sequence of storing the data follows the parameter capturing sequence to arrange the index values of the ten-scale linear spectrum pair parameters in the $0^{th}$ to $33^{rd}$ registers, the gain index values in the $34^{th}$ to $38^{th}$ registers, the sound/soundless bit in the $39^{th}$ bit, the pitch cycles in the $40^{th}$ to $46^{th}$ registers, and the $48^{th}$ bit is reserved for expansion.

In summation of the above description, the present invention herein enhances the performance of the speech coding/decoding method and speech coder/decoder than the conventional method and structure and further complies with the patent application requirements and is submitted to the Patent and Trademark Office for review and granting of the commensurate patent rights.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

CHART 1

| Sub-frame Number | Previous spectrum | Current spectrum |
|---|---|---|
| 1 | 7/8 | 1/8 |
| 2 | 5/8 | 3/8 |
| 3 | 3/8 | 5/8 |
| 4 | 1/8 | 7/8 |

What is claimed is:

1. A speech decoding method for speech decoder, the decoder having an impulse train generator 21 for receiving the pitch cycle parameter to generate an impulse train, a first random noise generator 22 for generating a random noise; when the sound/soundless determining unit 17 determines whether the speech is with sound, then the random noise and said impulse train are sent to an adder to generate the excitation source;

a second random noise generator 23 for generating a random noise; when the sound/soundless determining unit 17 determines the speech is without sound, then the random noise directly represents the excitation source;

a linear spectrum pair parameter interpolation (LSP Interpolation) 24 receiving said linear spectrum pair parameter, and interpolating the weighted index between the linear spectrum pair parameter of the quantized frame and the linear spectrum pair parameter of the previous quantized frame; a linear spectrum pair parameter to a linear predictive coefficient parameter (LSP to LPC) filter 25 for finding the ten-scale linear predictive coefficient of each synthesized frame by said interpolated linear spectrum pair parameter;

a synthetic filter for multiplying said ten-scale linear predictive coefficient with the past 10 speech signals and adding the speech excitation source and the gain parameter to obtain the synthesized speech corresponsive to the current speech excitation signal;

the method comprising the steps of:, dividing each frame into 4 sub-frames, and a ten-scale linear predictive coefficient being interpolated between a linear spectrum pair parameter of a current frame and a linear spectrum pair parameter of a previous frame for each synthesized sub-frame, and the solution being found by reversing the procedure by using the impulse train generator; furthermore, if the excitation source being sound, then the mixed excitation being adopted and composed of the impulse train generated by the pitch cycle and the random noises by using the first random noise generator 22; if the excitation source having no sound, then only the random noise being used for the representation by using the second random noise generator 23; moreover, after the excitation source with sound or without sound being generated, the excitation source must pass through a smooth filter to improve the smoothness of the excitation source; finally, by using the synthetic filter, the ten-scale linear predictive coefficient being multiplied by the past 10 synthesized speech signals and added to the foregoing speech excitation source signal and gain to obtain the synthesized speech corresponsive to the current speech excitation source signal.

* * * * *